US006140627A

United States Patent [19]

Jeon

[11] Patent Number: 6,140,627

[45] Date of Patent: Oct. 31, 2000

[54] CONTROL PANEL ASSEMBLY OF A MICROWAVE OVEN

[75] Inventor: Sei-ill Jeon, Koyang, Rep. of Korea

[73] Assignee: SamSung Electronics Co., Ltd., Suwon, Rep. of Korea

[21] Appl. No.: 09/493,120

[22] Filed: Jan. 28, 2000

[30] Foreign Application Priority Data

Feb. 27, 1999 [KR] Rep. of Korea ..... 99-3110 U

[51] Int. Cl.[7] ..... H05B 6/68

[52] U.S. Cl. ..... 219/702; 219/715; 200/5 E; 200/38 FA

[58] Field of Search ..... 219/702, 715, 219/719, 720; 99/325; 200/5 E, 5 A, 5 D, 38 A, 38 FA

[56] References Cited

U.S. PATENT DOCUMENTS

| | | | |
|---|---|---|---|
| 5,607,611 | 3/1997 | Lee | 219/702 |
| 5,728,997 | 3/1998 | Kim et al. | 219/702 |
| 6,057,533 | 5/2000 | Ahn | 219/715 |

*Primary Examiner*—Philip H. Leung
*Attorney, Agent, or Firm*—Robert E. Bushnell, Esq.

[57] ABSTRACT

A control panel assembly of a microwave oven which is easy to use, including: a front panel section having first and second cooking mode single-functional buttons comprised of a plurality of single-functional buttons for first and second cooking modes of the microwave oven, and a slot formed on the middle portion of the front panel section between the first and second cooking mode single-functional buttons; a movable switch disposed on the front panel section which is moved laterally along the slot of the front panel section; and a mode shifting switch for shifting cooking modes to the first and second cooking modes by the movement of the movable switch, wherein the first and second cooking modes are automatically selected by the movement of the movable switch, and the cooking mode single-functional button of the selected mode is exposed outward for pressing by a user. Accordingly, by simply moving the movable switch in a lateral direction, the cooking modes of the microwave oven are automatically selected. Also, the cooking mode single-functional button of the selected cooking mode is exposed, while the single-functional buttons of the unselected cooking mode are blocked by the movable switch. Accordingly, since there is a reduced number of exposed functional buttons, the appearance of the microwave oven is simple and clean. Further, by using the single-functional button for frequently cooked foods, the use of the control panel assembly becomes much easier.

6 Claims, 3 Drawing Sheets

CONTROL PANEL ASSEMBLY OF A MICROWAVE OVEN

CLAIM OF PRIORITY

This application makes reference to, incorporates the same herein, and claims all benefits accruing under 35 U.S.C. §119 from an application for ASSEMBLY CONTROL PANEL OF MICROWAVE OVEN earlier filed in the Korean Industrial Property Office on Feb. 27, 1999 and there duly assigned Ser. No. 3110/1999.

BACKGROUND OF THE INVENTION

1 Field of the Invention

The present invention relates to a control panel assembly for controlling a microwave oven.

2 Description of the Related Art

Generally, a microwave oven is a device for cooking food by using microwaves. A body of the microwave oven has a chamber formed on one side thereof for receiving food to be cooked, and microwave generating means disposed on the other side thereof for generating and radiating microwaves into the food in the chamber. Further, a control panel assembly is formed on the front side of the body. The control panel assembly has a plurality of buttons for controlling the operation of the microwave oven and for selecting various functions of the microwave oven.

The control panel assembly includes a front panel section having a plurality of function buttons arranged thereon for selecting various functions of the microwave oven, and a main board having a circuit for controlling the microwave oven to perform the selected function. The plurality of function buttons include an operation button, a cooking time setting dial, a cooking mode selecting button, and a cooking function selecting button, etc.

Meanwhile, as the functions of improved microwave ovens become diversified, more function buttons are required. Although the most important consideration is the convenience in manipulating the function buttons, considering the fact that there is growing number of appearance-conscious consumers, the function button arrangement which is not only easy to manipulate but also designed to improve the appearance of the microwave oven is needed.

In order to meet the above demand of current consumers, the trend has changed from the arrangement of many single-functional buttons on the front panel section toward the arrangement of a few multi-functional buttons. By using the multi-functional buttons, the number of functional buttons can be significantly reduced compared to using the single-functional buttons, and the appearance of the microwave oven can be simple. Here, the term "multi-functional button" means a button by which a user can select a plurality of functions of the microwave oven. For example, a user may select a first function of the microwave oven by pressing the multi-functional button once, and a second function by pressing the multi-functional button once again, etc. In accordance with the number of times the multi-functional button is pressed, the respective functions of the microwave oven can not be selected.

The control panel assembly of the microwave oven employing multi-functional buttons has the advantage of a neater appearance, however, the multi-functional buttons have a shortcoming in that they are difficult to use and users who are accustomed to single-functional buttons avoid buying such a microwave oven.

The control panel assembly employing single-functional buttons has the superiority to a control panel assembly employing multi-functional buttons in view of convenience of manipulation, however, the same has the disadvantage of a very complex-looking appearance due to the need of many functional buttons. Accordingly, consumers who are appearance-conscious avoid buying such a microwave oven.

Accordingly, there is a stronger demand for a functional button arrangement that would satisfy both demands of the consumers.

SUMMARY OF THE INVENTION

The present invention has been developed to overcome the above-mentioned shortcomings of the related art, and accordingly, it is an object of the present invention to provide a control panel assembly of a microwave oven which is both easy to manipulate, and has a simple and stylish appearance thanks to a reduced number of functional buttons exposed outwardly.

The above object is accomplished by a control panel assembly of a microwave oven according to the present invention, including a front panel section having first and second cooking mode single-functional buttons having a plurality of single-functional buttons for first and second cooking modes of the microwave oven, and a groove formed on a middle portion of the front panel section between the first and second cooking mode single-functional buttons; a movable switch disposed on the front panel section which is moved along the groove of the front panel section; and a mode shifting switch for shifting cooking modes to the first and second cooking modes by the movement of the movable switch.

The front panel section includes an oval-shaped slide section concaved from the surface of the front panel section to a predetermined depth for guiding the movement of the movable switch, and is arranged between the first and second cooking mode single-functional buttons.

Here, the first and second cooking mode single-functional buttons have 3–4 single-functional buttons, respectively, and the first cooking mode would be a warming mode, and the second cooking mode would be a defrosting mode.

Further, the movable switch includes a tact switch, an encoder, and a dial type encoder multi-functional button having a knob for operating the tact switch and a dial knob formed on the outer circumference of the knob used for operating the encoder. The encoder includes a groove formed on one side thereof for receiving the shifting projection of a mode shifting switch so that the modes of the microwave oven are automatically shifted by the movement of the movable switch.

In the control panel assembly of the microwave oven according to the present invention, by moving the movable switch, the cooking modes of the microwave oven are automatically selected. Further, the cooking mode single-functional button of the selected cooking mode is exposed outward for manipulation of the user, while the cooking mode single-functional button of the unselected cooking mode is blocked by the movable switch. Since there is a reduced number of exposed functional buttons, the appearance of the microwave oven is simple and chic. Further, by using a single-functional button for the most frequently cooked foods, the manipulation of the control panel assembly becomes easier.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 4 and 5 are sectional views for showing the examples of operating the control panel assembly according to the present invention, in which FIG. 4 shows the operation of the first cooking mode, and FIG. 5 shows the operation of the second cooking mode.

DETAILED DESCRIPTION OF THE PREFERRED EMBODIMENT

Figure 1:
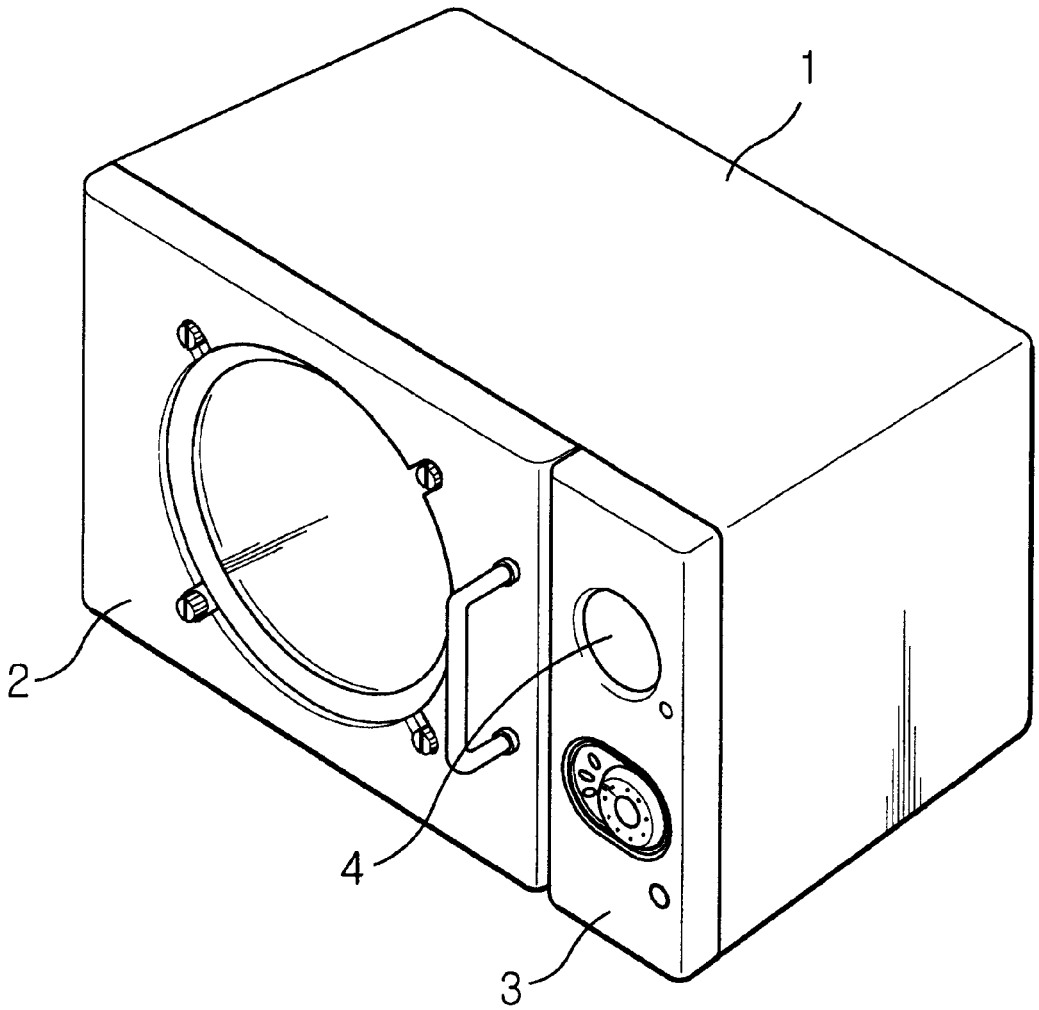
FIG. 1 is a perspective view for showing the appearance of a microwave oven employing a control panel assembly according to a preferred embodiment of the present invention.
Figure 2:
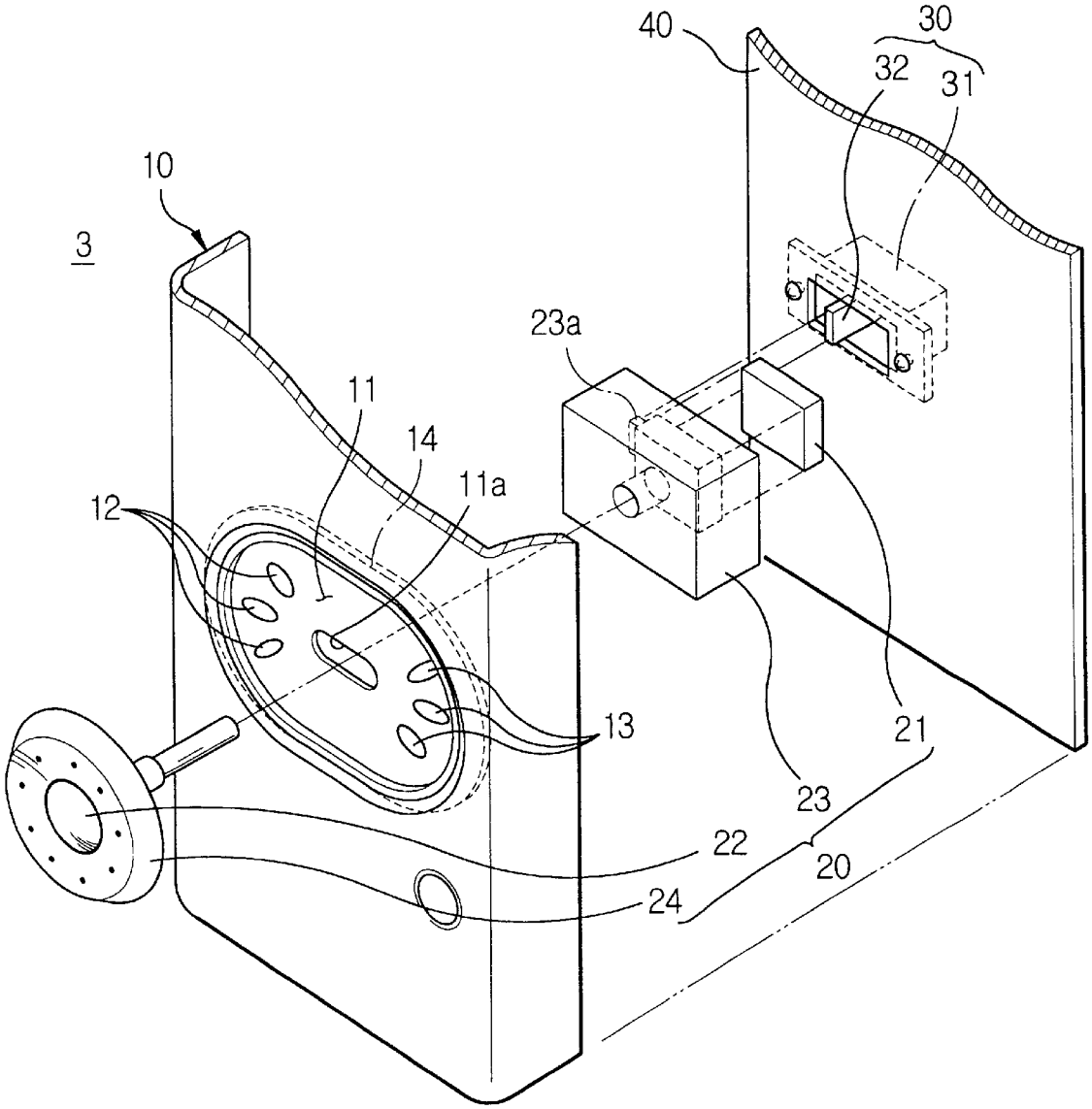
FIG. 2 is an exploded perspective view for showing the structure of the control panel assembly according to a preferred embodiment of the present invention.
Figure 3:
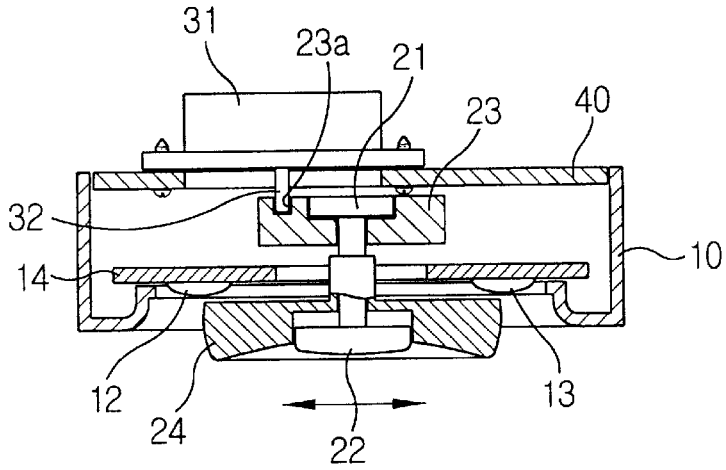
FIG. 3 is a sectional view for showing the control panel assembly of FIG. 2 being assembled.

A microwave oven employing a control panel assembly according to a preferred embodiment of the present invention is shown in FIGS. 1 to 3. FIG. 1 is a perspective view for showing the appearance of a microwave oven employing a control panel assembly according to a preferred embodiment of the present invention, FIG. 2 is an exploded perspective view for showing the structure of the control panel assembly according to the preferred embodiment of the present invention, and FIG. 3 is a sectional view for showing the control panel assembly of FIG. 2 being assembled.

In the drawings, the reference numeral 1 refers to a body of a microwave oven, 2 is a door, and 3 is a control panel assembly. As shown in FIG. 1, within the body 1 of the microwave oven, a cooking chamber for receiving food to be cooked, and a device chamber are formed. Albeit not shown in the drawings, the device chamber has microwave generating means therein for generating and radiating the microwaves of a certain frequency into the food in the cooking chamber. The door 2 is pivotally disposed on the body 1 of the microwave oven to open/close the cooking chamber. Further, the control panel assembly 3 is formed on the front side of the body 1. The reference numeral 4 is a display.

As shown in FIGS. 2 and 3, the control panel assembly 3 includes a front panel section 10, a movable switch 20, and a mode shifting switch 30.

The front panel section 10 has a slide section 11 which is concaved from the surface of the front panel section 10 to a predetermined depth. A slot 1*a* is formed on the middle portion of the slide section 11. Also, the slot 11*a* is formed between the first cooking mode single-functional button 12 and the second cooking mode single-functional button 13. Here, the first and second cooking mode single-functional buttons 12 and 13 may be for warming and defrosting modes, respectively, and are formed of a plurality of single-functional buttons, approximately from 3 to 4 (3 in FIG. 2) for the corresponding cooking modes, respectively. The number of single-functional buttons, however, is not strictly limited. The respective single-functional buttons constituting the first and second cooking mode single-functional buttons 12 and 13 are supported on a separate circuit board 14. More specifically, by attaching the board 14 onto the back side of the front panel section 10, the respective single-functional buttons are exposed outwardly.

The movable switch 20 is laterally moved along the slot 11*a* formed on the middle portion of the front panel section 10. The movable switch 20 includes a tact switch 21, an encoder 23, and a dial type encoder multi-functional buttons having a knob 22 formed on the middle portion of the dial type encoder multi-functional button for operating the tact switch 21, and a dial knob 24 formed on the outer circumference of the knob 22 for operating the encoder 23. Here, the knob 22 controls the operation of the microwave oven, and the dial knob 24 sets the cooking time.

Meanwhile, the mode shifting switch 30 is attached on the main board 40, and has a shifting projection 32 movably formed on the middle portion of a body 31 thereof. By the selective movement of the shifting projection 32, the mode of the microwave oven is shifted. More specifically, as the shifting projection 32 is moved toward one end of the mode shifting switch 30, the first cooking mode is selected, while, when the shifting projection 32 is moved toward the other end of the mode shifting switch 30, the second cooking mode is selected. In this embodiment of the present invention, the shifting operation of the shifting projection 32 is automatically performed by the lateral movement of the movable switch 20.

Accordingly, a groove 23*a* is formed on one side of the encoder 23 of the movable switch 20, to receive the shifting projection 32 of the mode shifting switch 30. Thus, by laterally moving the movable switch 20, the shifting projection 32 of the mode shifting switch 30 is moved and automatically shifts the mode of the microwave oven.

Further, in the control panel assembly 3 according to the present invention, in addition to the automatic selection of the cooking modes by the lateral movement of the movable switch 20 on the slide section 11 of the front panel 10, the first and second cooking mode single-functional buttons 12 and 13 can also be selected. For example, when selecting the first cooking mode, the first cooking mode single-functional button 12 is exposed outward for pressing by a user. In this situation, the second cooking mode single-functional buttons 13 of the unselected cooking mode is blocked by the movable switch 20. Accordingly, the number of exposed functional buttons can be significantly reduced.

Since the control panel assembly according to the present invention employs a few easy-to-manipulate single-functional buttons used for the frequently selected foods, while employing the dial type encoder button as the multi-functional buttons corresponding to the additional functions of the microwave oven, the control panel assembly is easy to manipulate while still having the ability to properly cook various foods by the selective manipulation of the functional buttons. More specifically, since the proper cooking time for the respective foods is pre-set in the single-functional buttons of the microwave oven, the user can easily and properly cook the food by simply pressing the corresponding single-functional buttons. Also, when cooking food which is not pre-set in the single-functional buttons, a user can properly cook the food by readjusting the cooking time with the dial knob 24 of the movable switch 20.

The manipulation of the control panel assembly constructed as above according to the preferred embodiment of the present invention will be described below with reference to the accompanied FIGS. 4 and 5.

Figure 4:
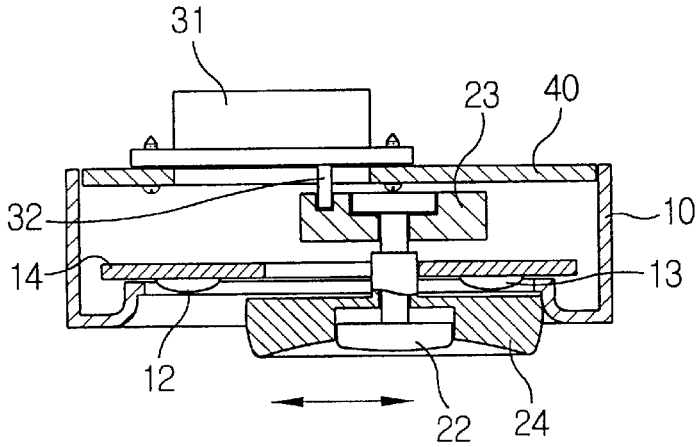
Figure 5:
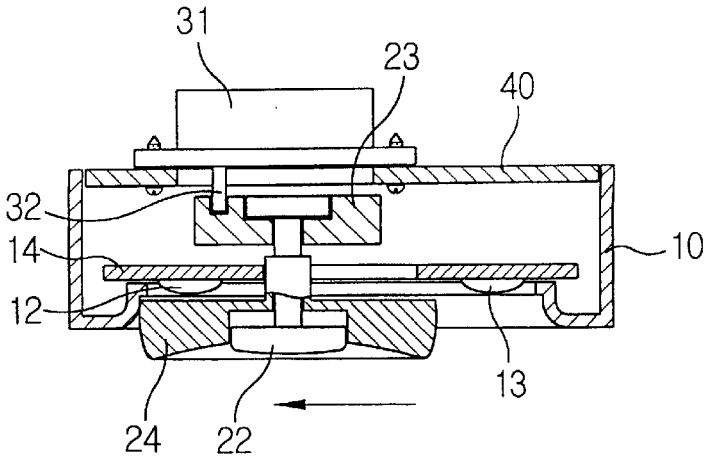

FIGS. 4 and 5 are sectional views for showing the examples of operating the control panel assembly according to the present invention, in which FIG. 4 shows the operation of the first cooking mode, and FIG. 5 shows the operation of the second cooking mode. Hereinafter, the first cooking mode will be referred to as the warming mode, and the second cooking mode is referred to as the defrosting mode.

First, a user places the food to be cooked in the cooking chamber of the microwave oven, and selects the cooking method for the food. Here, according to the present invention, a user selects the cooking method by laterally moving the movable switch 20 of the control panel assembly 3.

More specifically, as shown in FIG. 4, when warming food, a user moves the movable switch 20 to the right-hand side. Then, by the movement of the movable switch 20, the shifting projection 32 of the mode shifting switch 30 in the microwave oven is moved to the right-hand side, and the warming mode is automatically selected. By the movement of the movable switch 20, the first cooking mode single-functional button 12 is exposed outwardly for the user to press, while the second cooking mode single-functional button 13 of the unselected defrosting cooking mode is blocked by the movable switch 20.

After pressing the corresponding single-functional buttons for the food in the microwave oven, the user starts the operation of the microwave oven by turning the knob 22.

In such a situation, when the food in the cooking chamber is not the kind which is pre-set in the first cooking mode single-functional button 12, a user can set the proper cooking time by turning the dial knob 24 of the movable switch 20 which activates the cooking operation.

Meanwhile, when defrosting the food, as shown in FIG. 5, a user moves the movable switch 20 to the left-hand side to select the defrosting mode. Then, the user presses the single-functional buttons of the second cooking mode single-functional button 13 corresponding to the selected defrosting mode, and begins the defrosting operation by turning the knob 22. In this situation also, when the food in the cooking chamber is not the kind of food which is pre-set in the single-functional buttons, or when the quantity of food is larger than normal, the user resets the proper cooking time by turning the dial knob 24 of the movable switch 20.

As described above, in the control panel assembly 3 of the microwave oven according to the present invention, the cooking modes are automatically selected by the lateral movement of the movable switch 20. Also, the cooking mode single-functional button of the selected mode is exposed outwardly for pressing by the user, while the cooking mode single-functional button of the unselected mode is blocked by the movable switch 20. Accordingly, since there is a reduced number of exposed single-functional buttons, the appearance of the microwave oven is simple and more attractive.

Further, since the control panel assembly 3 according to the present invention employs single-functional buttons for frequently cooked foods, it is easier to simply press the desired single-functional buttons.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A control panel assembly of a microwave oven, comprising:

a front panel section including first and second cooking mode single-functional buttons having a plurality of single-functional buttons for first and second cooking modes of the microwave oven, and a slot formed on the middle portion of the front panel section between the first and second cooking mode single-functional buttons;

a movable switch disposed on the front panel section which is moved along the slot of the front panel section; and a mode shifting switch for shifting cooking modes to the first and second cooking modes by the movement of the movable switch, wherein the first and second cooking modes are automatically selected by the movement of the movable switch, and the cooking mode single-functional button of the selected mode is exposed outward for pressing by a user.

2. The control panel assembly as claimed in claim 1, wherein the front panel section comprises an oval-shaped slide section concaved from the surface of the front panel section to a predetermined depth for guiding the movement of the movable switch, and is arranged between the first and second cooking mode single-functional buttons.

3. The control panel assembly as claimed in claim 1, wherein the first and second cooking mode single-functional buttons comprise 3–4 single-functional buttons, respectively.

4. The control panel assembly claimed in claim 1, wherein the movable switch comprises a tact switch, an encoder, and a dial type encoder multi-functional button having a knob for operating the tact switch and a dial knob formed on the outer circumference of the knob for operating the encoder, wherein the encoder has a groove formed on one side thereof for receiving a shifting projection of a mode shifting switch so that the cooking modes of the microwave oven are automatically shifted by the movement of the movable switch.

5. The control panel assembly as claimed in claim 1, wherein the first cooking mode is a warming mode, and the second cooking mode is a defrosting mode.

6. A microwave oven comprising:

a body having a cooking chamber for receiving food to be cooked;

microwave generating means disposed in a device chamber formed in one side of the body for generating and radiating microwaves of a certain frequency to the food in the cooking chamber; and a control panel assembly having a plurality of buttons for controlling the operation of the microwave oven and for selecting varied functions of the microwave oven, wherein the control panel assembly comprises:

a front panel section having first and second cooking mode single-functional buttons including a plurality of single-functional buttons for first and second cooking modes of the microwave oven, and a slot formed on the middle portion of the front panel section between the first and second cooking mode single-functional buttons;

a movable switch disposed on the front panel section and is moved along the groove of the front panel section; and a mode shifting switch for shifting cooking modes to the first and second cooking modes by the movement of the movable switch, wherein the first and second cooking modes are automatically selected by the movement of the movable switch, and the cooking mode single-functional button of the selected mode is exposed outward for pressing by a user.

* * * * *